United States Patent [19]

Scaglione

[11] Patent Number: 5,050,749

[45] Date of Patent: Sep. 24, 1991

[54] KNIFE RACK

[76] Inventor: Paul J. Scaglione, 25495 Skye Dr., Farmington Hills, Mich. 48336

[21] Appl. No.: 589,415

[22] Filed: Sep. 28, 1990

[51] Int. Cl.[5] ..... A47F 7/00

[52] U.S. Cl. ..... 211/70.7; 248/37.6

[58] Field of Search ..... 248/37.6, 37.3; 211/70.7

[56] References Cited

U.S. PATENT DOCUMENTS

| | | | |
|---|---|---|---|
| 768,266 | 8/1904 | Cary | 248/37.6 |
| 1,569,508 | 1/1926 | Lee | 248/37.6 |
| 2,089,537 | 8/1937 | Chaplin | 248/37.6 |
| 2,157,412 | 5/1939 | Hopkins | 248/37.6 |
| 2,183,074 | 12/1939 | Hopkins | 248/37.6 |
| 2,338,303 | 1/1944 | Rosenberg | 248/37.6 |
| 3,926,419 | 12/1975 | Kenny | 248/37.6 X |
| 4,071,212 | 1/1978 | Burrows et al. | 248/37.6 |
| 4,511,040 | 4/1985 | Tolentino | 248/37.6 X |

FOREIGN PATENT DOCUMENTS

| | | | |
|---|---|---|---|
| 2495531 | 6/1982 | France | 211/70.7 |

*Primary Examiner*—Ramon O. Ramirez

*Attorney, Agent, or Firm*—Robert G. Mentag

[57] ABSTRACT

A knife rack including a back plate, on the front face of which is positioned a plurality of laterally spaced apart ribs to form a plurality of vertically disposed channels for the storage of a plurality of knives. A horizontal retainer bar is mounted across the outer face of the vertical ribs in a position adjacent the upper end of the ribs, so as to retain stored knives in the said channels. The knife rack is adapted for attachment to the inner side of a face kitchen cabinet door, or on a kitchen wall, or some like surface to which the knife rack may be secured.

3 Claims, 2 Drawing Sheets

KNIFE RACK

BACKGROUND OF THE INVENTION

1. Field of the Invention

The field of art to which this invention pertains may be generally located in the class of devices relating to knife holders. Class 224, Package and Article Carrier, Sub-Class 232, United States Patent Office Classification, appears to be the applicable general area of art to which the subject matter similar to this invention have been classified in the past.

2. Description of the Prior Art

It is well known in the knife holder or rack art to employ wood knife blocks which sit on kitchen counter tops. These wood knife blocks hold a number of clustered knives in storage slots. A disadvantage of such wood knife blocks is that they occupy valuable counter space. A problem encountered with these wood knife blocks is that the slots in which the knives are stored are subject to an accumulation of dust and dirt, and such a situation results in unhealthy and unsanitary conditions. It is also common to store knives in kitchen cabinet drawers, either in trays or laying loose and in random positions, together with other kitchen utensils stored in such drawers. A disadvantage of storing knives in kitchen cabinet drawers is that such a storage practice occupies valuable drawer space which could be otherwise employed for storing other needed kitchen utensils. The method of storing knives in kitchen cabinet drawers presents a serious and potential safety hazard problem, because of the exposed knife edges which can cut the fingers of a person reaching for a particular knife or utensil in such a drawer used for the storing of both knives and kitchen utensils. A further disadvantage of storing knives in a kitchen cabinet drawer is that the knives are laying loose and the edges thereof can be become dull due to contact with other kitchen utensils or other objects laying in the drawer.

SUMMARY OF THE INVENTION

In accordance with the present invention, a novel and improved knife rack is provided which is attachable to kitchen cabinet doors, walls, or the like. The knife rack may be made of molded plastic, wood, metal or composition material that can be attached to the inner surface or the outer surface of a kitchen cabinet door. A preferable location for the knife rack is on the inner surface of a kitchen cabinet door, because the knives held in the knife rack will then be kept in a safe and clean environment. The knife rack will fit between the inner surface of a kitchen cabinet door and the shelves inside of the cabinet, so as not to infringe on the shelf space where dishes and other utensils may be stored. An advantage of the mounting of the knife rack on the inner surface of a kitchen cabinet door is that this location frees up kitchen drawer space, or kitchen counter space, which heretofore were locations for commonly storing knives.

The knife rack of the present invention includes a back plate, on the front side of which is provided a plurality of vertically disposed channels, which are each adapted to receive and store a single knife. The channels are created and separated by a plurality of vertical ribs, which also function to provide vertical structural stability to the back plate. A horizontally disposed knife retainer bar is positioned on the front or outer side of the vertical ribs, adjacent the top of the vertical ribs, but in a position spaced downwardly from the top edge of the back plate, so as to create a striking area, on the front side upper surface of the back place for the points of the knives as they are inserted into a respective channel in a position between the back plate and the horizontal retainer bar. The horizontal retainer bar functions to secure the knives in place in each of the channels and it also provides horizontal structural stability to the knife rack. The length of the channels may vary in accordance with the length of the knives that are desired to be stored in a particular knife rack. The plurality of knife storage channels may be opened on the front sides thereof, below the horizontal knife retainer bar, or the front sides open area may be covered by a thin wall of suitable material as for example, a suitable transparent material.

Accordingly, it is an object of the present invention to provide a knife rack which may be easily mounted on the inner surface of a kitchen cabinet door, or the like, or be wall mounted. The knife rack is constructed so that its thickness will allow it to fit closely between the inner surface of a kitchen cabinet door and the adjacent edge of a cabinet shelf. The space between the inner surface of a kitchen cabinet door and the edge of the adjacent cabinet shelves varies, but at the present time kitchen cabinets available on the market today allow about a $\frac{5}{8}$ of an inch to $\frac{3}{4}$ of an inch space between the kitchen cabinet door and the shelves in the cabinet. The last mentioned space is determined by the thickness of a kitchen cabinet panel or wall. The knife rack may be mounted to kitchen cabinet doors or walls, by any suitable attachment means, as for example screws, bolts, adhesives, magnets, or the like.

It is another object of the present invention to provide a knife rack which includes a vertical back plate on which are formed a plurality of channels for the reception and storage of knives in individual channels and wherein a strike space is provided on the front side of the back plate, above a horizontal retainer bar, in each channel. Upon insertion of a knife in a channel for storing the same, the point of the knife will strike such strike space and allow the knife to be pivoted vertically toward the back plate, and to then slide down into a storage position in its respective storage channel. The last described structural feature is an advantage because it prevents the kitchen cabinet door from being scratched or marred by the constant insertion and withdrawal of knives from the knife rack.

Other features and advantages of the present invention will be apparent from the following detailed description, appended claims and the accompanying drawings.

DESCRIPTION OF THE PREFERRED EMBODIMENTS

Figure 1:
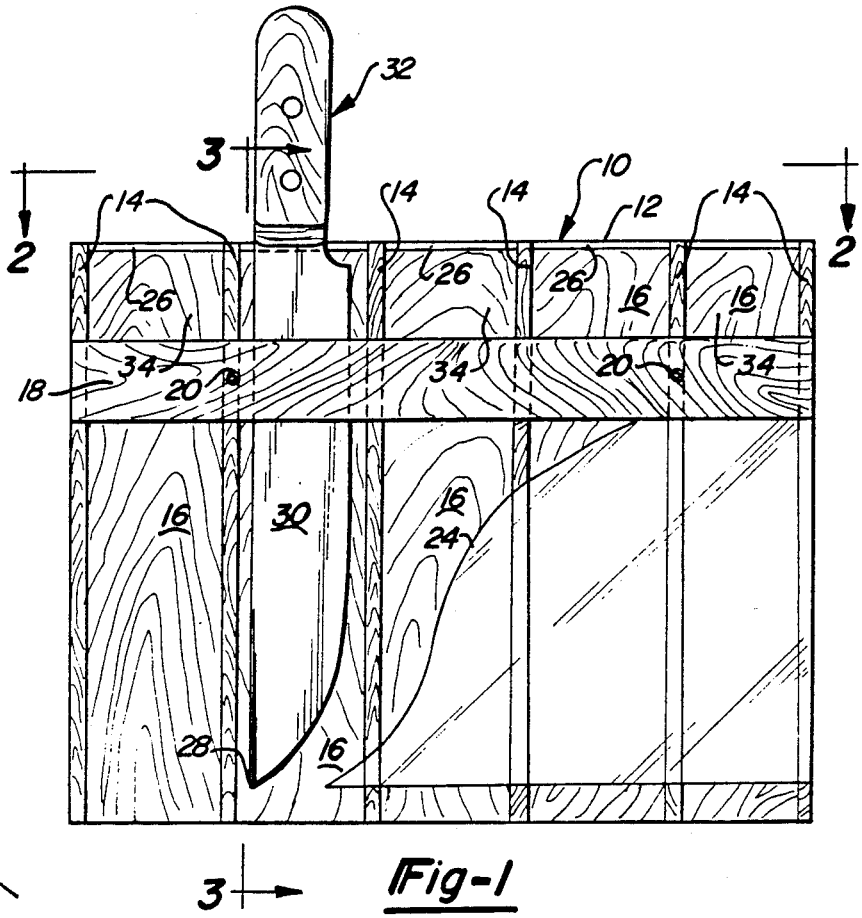
FIG. 1 is front elevation view, with a part broken away, of a knife rack made in accordance with the principles of the present invention.

Referring now to the drawings, and in particular to FIGS. 1 through 5, the numeral 10 generally designates a knife rack made in accordance with the principles of the present invention. The knife rack 10 includes a back plate 12 which is substantially rectangular in front plan view. Operatively mounted on the front side of the back plate 12 are a plurality of vertically disposed ribs 14 which form a channel 16 between each pair of adjacent ribs 14. A horizontal retainer bar 18 is attached to the vertical ribs 14 and to the back plate 12, by any suitable means, or by a plurality of suitable screws 20. The knife rack back plate 12, the ribs 14 and the retainer bar 18 may be made from any suitable material, as for example wood, plastic, metal, and so forth. The ribs 14 could be adhered to the back plate 12 by a suitable adhesive. The retainer bar 18 may also be secured to the ribs 14 by a suitable adhesive. The knife rack 10 is preferably made from a suitable plastic material, by any suitable method, as for example, by an injection molding operation, which would mold the back plate 12, ribs 14, and the retainer bar 18 as a unitary structure.

Figure 3:
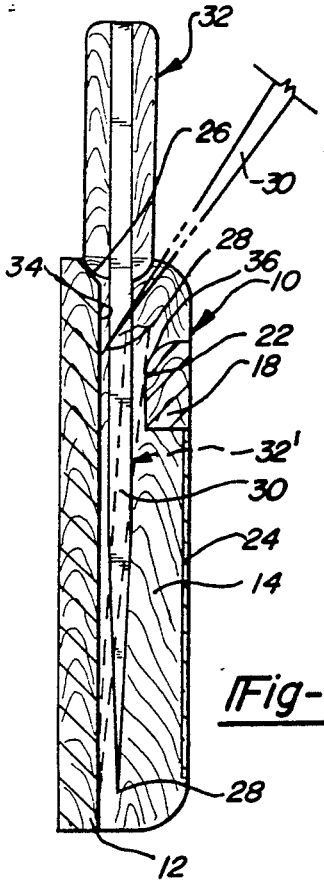
FIG. 3 is an elevation section view of the knife rack illustrated in FIG. 1, taken along the line 3—3 thereof, and looking in the direction of the arrows.
Figure 2:
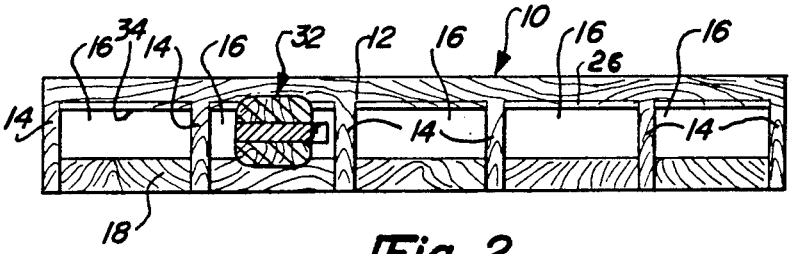
FIG. 2 is a top plan view of the knife rack illustrated in Fig. 1, taken along the line 2—2 thereof, and looking in the direction of the arrows.
Figure 5:
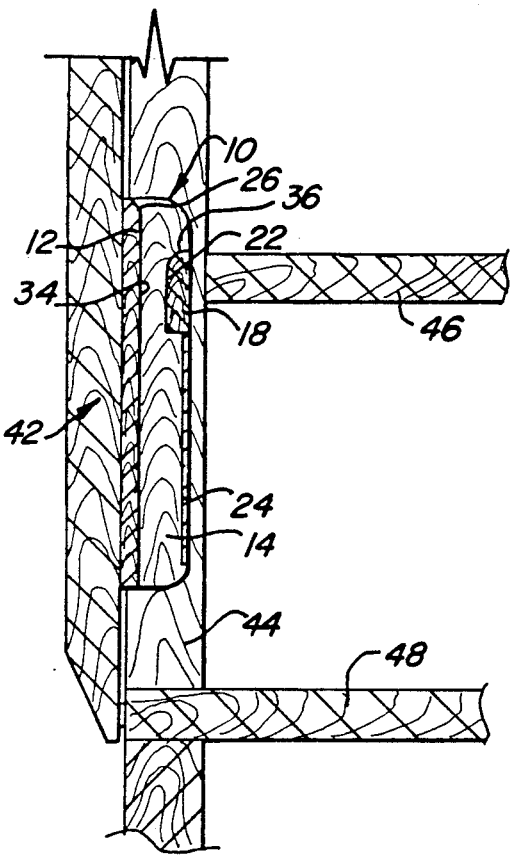
FIG. 5 is fragmentary, elevation section view of the knife rack structure illustrated in FIG. 4, taken along the line 5—5 thereof, and looking in the direction of the arrows, and showing how the knife rack fits closely between the inner surface of a kitchen cabinet door and the adjacent kitchen cabinet shelf space.

As shown in FIGS. 3 and 5, the retainer bar 18 is positioned in recesses 22 in the front side of the ribs 14, adjacent the upper end of the back plate 12. As shown in FIGS. 1, 3 and 5, a cover member 24 may be optionally mounted across the front faces of the ribs 14, below the retainer bar 18, and secured in place by any suitable means, as by a suitable adhesive. The cover 24 may be made from any suitable material, as for example, a transparent plastic material.

As best seen in FIGS. 1 and 3, the upper end front edge of the back plate 12 is provided with a forwardly facing taper 26, between each of the ribs 14.

As illustrated in FIG. 3, when a knife 32 is being inserted into one of the channels 16 of the knife rack 10, the point 28 of the blade 30 of the knife 32 will hit the back plate 12 at the strike area 34, on the upper front face of the back plate 12, above the retainer bar 18. The knife 32 is then pivoted into a vertical position as shown in FIG. 3, and it then slides down and engages the tapered front edge 26 on the back plate 12 and slides forwardly outward from the back plate 12, so that the blade 30 engages the inner side of the retainer bar 18, and with the knife blade point 28 pivoted towards the back plate 12. The knife then slides downwardly into seating engagement against the retainer bar 18, as shown by the knife broken line outline 32'. The retainer bar 18 has a rounded top inner edge, as shown by the numeral 36 in FIG. 3. The rounded edge 36 allows the knife blade 30 of the knife 32 to slide freely into the space between the front side of the back plate 12 and the inner side of the retainer bar 18.

Figure 6:
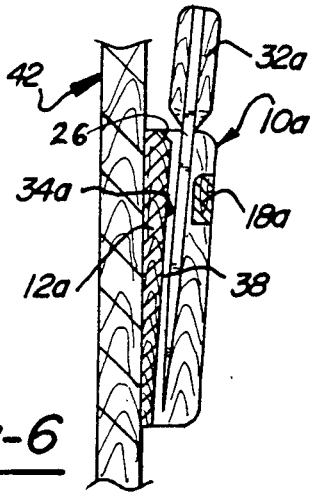
FIG. 6 is a fragmentary, vertical section view of a modified knife rack, mounted on the inner surface of a kitchen cabinet door, and with its back plate having a tapered vertical cross section so as to pivot the handles of knives mounted in this modified embodiment out a little further from the kitchen door, so as to make the knife handles a little more accessible.

FIG. 6 illustrates a modified embodiment of a knife rack made in accordance with the principles of the present invention. The parts of the embodiment of FIG. 6 which are the same as the parts of the first embodiment of FIGS. 1 through 5 have been marked with the same reference numerals followed by the small letter "a". In the embodiment of FIG. 6, the back plate 12*a* is provided with a tapered front surface 38 which functions to cause the handle of a knife 32*a* mounted in one of the channels on the knife rack 10*a* to pivot slightly away from a kitchen cabinet door 42 on which the knife rack 10*a* is mounted. The knife rack 10*a* of FIG. 6 makes the handle of the knife 32*a* a little more accessible then in the embodiment wherein the back plate 12 has a vertical front face instead of a tapered front face.

Figure 4:
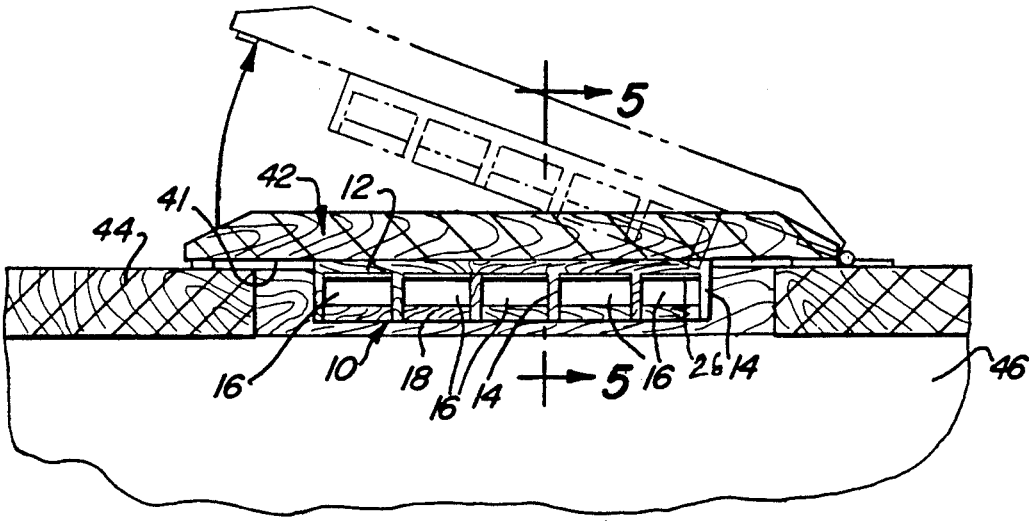
FIG. 4 is a top plan view of the knife rack illustrated in FIGS. 1-3, and illustrating how it is mounted on the inside surface of a kitchen cabinet door and how it fits closely between the kitchen cabinet door and the kitchen cabinet shelf space.
Figure 7:
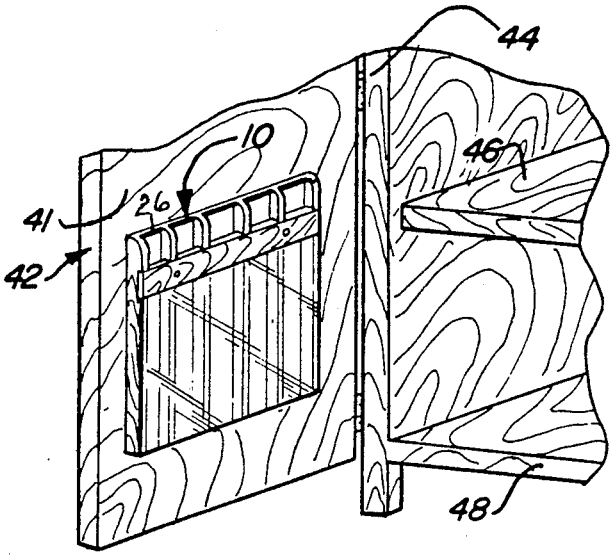
FIG. 7 is an elevational perspective view of a knife rack made in accordance with the principles of the present invention, and showing the knife rack mounted on the inner surface of a kitchen cabinet door which is swung open to a position away from the kitchen cabinet shelves.

FIG. 7 shows a knife rack 10, made in accordance with the principles of the present invention, mounted on the inner side 41 of a kitchen cabinet door 42. The numeral 44 designates the front kitchen cabinet panel or wall on which the kitchen cabinet door 42 is mounted. The numerals 46 and 48 designate shelves in the kitchen cabinet. FIG. 7 is an elevation perspective view of the kitchen cabinet and knife rack structure illustrated in FIG. 5, and showing the kitchen cabinet door 42 swung to an open position away from the kitchen cabinet shelves 46 and 48. FIGS. 4 and 5 clearly illustrate how the knife rack 10 of the present invention can be mounted on the inner face of a kitchen cabinet door, and function without any interference with the shelves in the kitchen cabinet. The knife rack 10 may be attached to the inner side of a kitchen cabinet door 42, by any suitable means, as by screws, bolts, adhesive, or the like.

It will be understood from a viewing of FIGS. 4 and 5, that a knife rack 10 made in accordance with the principles of the present invention fits closely into the area between the kitchen cabinet door 42 and the shelves 46 and 48. It will also be understood that the width of the area in which the knife rack 10 is disposed is determined by the thickness of the kitchen cabinet wall 44. It will be seen that when a kitchen cabinet door 42, as shown in FIG. 7, is swung to an open position, that the knives mounted in the knife rack 10 are easily and quickly accessible.

It will be understood that the knife rack 10 of the present invention may have a plurality of channels 16 of various widths for different sizes of knives 32. The back plate 12 of the knife rack 10 may also be made to different vertical lengths, in accordance with the different lengths of knives 32 desired to be stored in a knife rack 10. It will also be understood, there may be more than one horizontal retainer bar 18 employed in a knife rack 10.

What is claimed is:

1. A knife rack (10) adapted to be attached to a supporting surface for storing knives, characterized in that:

(a) said knife rack (10) includes a vertical back plate (12) having a front side with a top edge that can be attached to a supporting surface;

(b) said back plate (12) has provided on the front side thereof a plurality of vertical ribs (14) which are laterally spaced apart to provide a plurality of channels (16) for the reception and storage of knives (32);

(c) at least one horizontal retainer bar (18) having a top edge is disposed on the vertical ribs (14), in a position spaced apart from the front side of the knife rack (10), for retaining different size knives (32) securely stored in the channels (16), between the ribs (14);

(d) the horizontal retainer bar (18) is spaced downwardly in close proximity from the upper end of the back plate (12) to provide a flat, straight downward striking area for the points of knives (32) being mounted in the channels (16) of the knife rack (10); and, (e) the top front edge (26) of the back plate (12) between each of the ribs (14) is tapered so that a knife handle, upon insertion of a knife (32) into a channel (16), will slide downward by its own weight into an engagement with said back plate tapered edge (26) and the knife (32) will be pivoted outwardly, away from the back plate (12), and into sliding engagement with the retainer bar (18) and cause the point (28) of the knife blade (30) to rest against the back plate (12) and thereby secure the knife (32) in the rack (10) without distortion of the knife blade (30).

2. A knife rack (10) as defined in claim 1, characterized in that:

(a) the top inner edge (36) of the horizontal retainer bar (18) is rounded to facilitate the insertion or withdrawal of a knife (32) in each channel (16).

3. A knife rack (**10*a*) as defined in claim 1**, characterized in that:

(a) the knife rack back plate (**12*a*) is provided with a downwardly and inwardly tapered front face (38), so that the bottom edge is thinner than the top edge, thereby causing knife handles to be positioned slightly away from a supporting surface on which the knife rack (10*a***) may be mounted.

* * * * *